US010915035B2

(12) United States Patent
Murata et al.

(10) Patent No.: US 10,915,035 B2
(45) Date of Patent: Feb. 9, 2021

(54) CARRIER FOR DEVELOPING ELECTROSTATIC LATENT IMAGE, TWO-COMPONENT DEVELOPER, DEVELOPER FOR REPLENISHMENT, IMAGE FORMING DEVICE, PROCESS CARTRIDGE, AND IMAGE FORMING METHOD

(71) Applicants: Haruki Murata, Kanagawa (JP); Hiroyuki Kishida, Shizuoka (JP); Toyoaki Tano, Shizuoka (JP); Kenichi Mashiko, Shizuoka (JP); Masato Taikoji, Shizuoka (JP); Mariko Takii, Kanagawa (JP); Yoshihiro Murasawa, Shizuoka (JP)

(72) Inventors: Haruki Murata, Kanagawa (JP); Hiroyuki Kishida, Shizuoka (JP); Toyoaki Tano, Shizuoka (JP); Kenichi Mashiko, Shizuoka (JP); Masato Taikoji, Shizuoka (JP); Mariko Takii, Kanagawa (JP); Yoshihiro Murasawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 14 days.

(21) Appl. No.: 16/305,196

(22) PCT Filed: May 26, 2017

(86) PCT No.: PCT/JP2017/019705
§ 371 (c)(1),
(2) Date: Nov. 28, 2018

(87) PCT Pub. No.: WO2017/208994
PCT Pub. Date: Dec. 7, 2017

(65) Prior Publication Data

US 2020/0183297 A1 Jun. 11, 2020

(30) Foreign Application Priority Data

May 31, 2016 (JP) ..... 2016-108698

(51) Int. Cl.
*G03G 9/00* (2006.01)
*G03G 9/113* (2006.01)
(Continued)

(52) U.S. Cl.
CPC ..... *G03G 9/1139* (2013.01); *G03G 9/0819* (2013.01); *G03G 9/0821* (2013.01);
(Continued)

(58) Field of Classification Search
CPC ..... G03G 9/1139; G03G 9/1131
(Continued)

(56) References Cited

U.S. PATENT DOCUMENTS 5,093,201 A 3/1992 Ohtani et al.
5,272,037 A 12/1993 Ohtani et al.
(Continued)

FOREIGN PATENT DOCUMENTS

JP 2-187771 A 7/1990
JP 05-119542 5/1993
(Continued)

OTHER PUBLICATIONS

Japanese Office Action dated Mar. 17, 2020 in Japanese Patent Application No. 2016-108698, 5 pages.
(Continued)

*Primary Examiner* — Mark A Chapman
(74) *Attorney, Agent, or Firm* — Oblon, McClelland, Maier & Neustadt, L.L.P.

(57) ABSTRACT

A carrier for developing an electrostatic latent image includes a core material particle and a resin layer covering a surface of the core material particle. The resin layer
(Continued)

includes a resin and at least one kind of a fine particle. At least one kind of the fine particles includes a chargeable fine particle. The chargeable fine particle has a long diameter of 400 to 900 nm. The chargeable fine particle has a shape factor SF-1 of 160 to 250.

9 Claims, 1 Drawing Sheet

(51) Int. Cl.
*G03G 9/08* (2006.01)
*G03G 15/08* (2006.01)

(52) U.S. Cl.
CPC ..... *G03G 9/1131* (2013.01); *G03G 15/08* (2013.01); *G03G 2215/0607* (2013.01)

(58) Field of Classification Search
USPC ..... 430/111.1, 111.35
See application file for complete search history.

(56) References Cited

U.S. PATENT DOCUMENTS

| | | | |
|---|---|---|---|
| 2009/0142678 | A1 | 6/2009 | Yagi et al. |
| 2010/0233613 | A1 | 9/2010 | Masuda et al. |
| 2010/0239975 | A1 | 9/2010 | Yamaguchi et al. |
| 2011/0086307 | A1 | 4/2011 | Nakajima et al. |
| 2011/0091802 | A1 | 4/2011 | Takahashi et al. |
| 2011/0171573 | A1 | 7/2011 | Sakata et al. |
| 2011/0229812 | A1 | 9/2011 | Takahashi et al. |
| 2011/0229817 | A1 | 9/2011 | Yamada et al. |
| 2012/0057898 | A1 | 3/2012 | Sakata et al. |
| 2012/0064451 | A1 | 3/2012 | Kishida et al. |
| 2013/0065175 | A1 | 3/2013 | Sakata et al. |
| 2013/0101930 | A1 | 4/2013 | Yamaguchi et al. |
| 2013/0157186 | A1 | 6/2013 | Ono et al. |
| 2013/0252169 | A1 | 9/2013 | Yaguchi et al. |
| 2014/0023966 | A1 | 1/2014 | Sawada et al. |
| 2014/0072910 | A1 | 3/2014 | Iwatsuki et al. |
| 2014/0080052 | A1 | 3/2014 | Yaguchi et al. |
| 2014/0227638 | A1 | 8/2014 | Kishida et al. |
| 2014/0248557 | A1 | 9/2014 | Yaguchi et al. |
| 2015/0153665 | A1 | 6/2015 | Kishida et al. |
| 2016/0363880 | A1 | 12/2016 | Takii et al. |
| 2017/0153563 | A1 | 6/2017 | Kishida et al. |
| 2017/0185000 | A1 | 6/2017 | Nagayama et al. |
| 2017/0205721 | A1 | 7/2017 | Murasawa et al. |
| 2017/0269497 | A1 | 9/2017 | Murasawa et al. |

FOREIGN PATENT DOCUMENTS

| | | |
|---|---|---|
| JP | 2009-063805 | 3/2009 |
| JP | 2011-065092 | 3/2011 |
| JP | 2011-145388 A | 7/2011 |
| JP | 2011-145397 A | 7/2011 |
| JP | 2012-047971 | 3/2012 |
| JP | 2013-127587 A | 6/2013 |
| JP | 5327500 | 8/2013 |

OTHER PUBLICATIONS

International Search Report dated Jul. 14, 2017 in PCT/JP2017/019705 filed on May 26, 2017.

[Fig. 1]
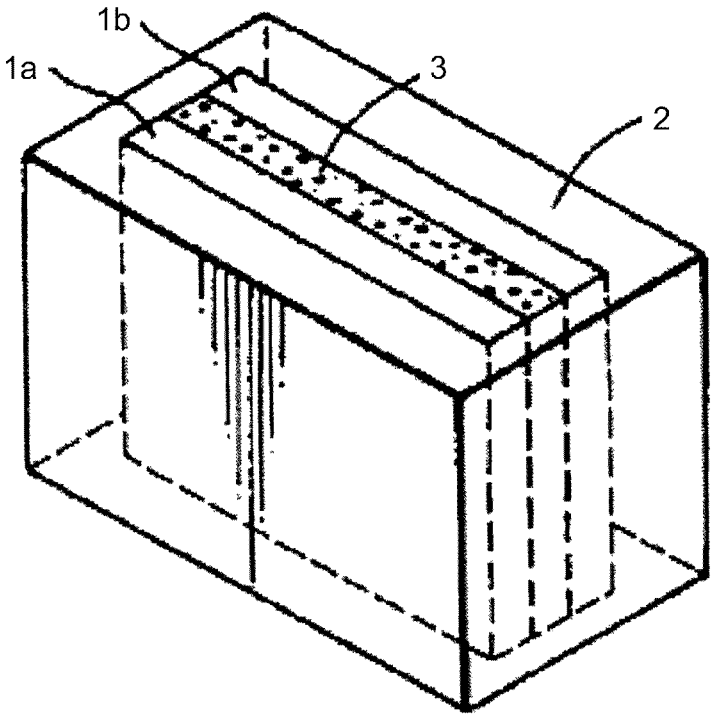
[Fig. 2]
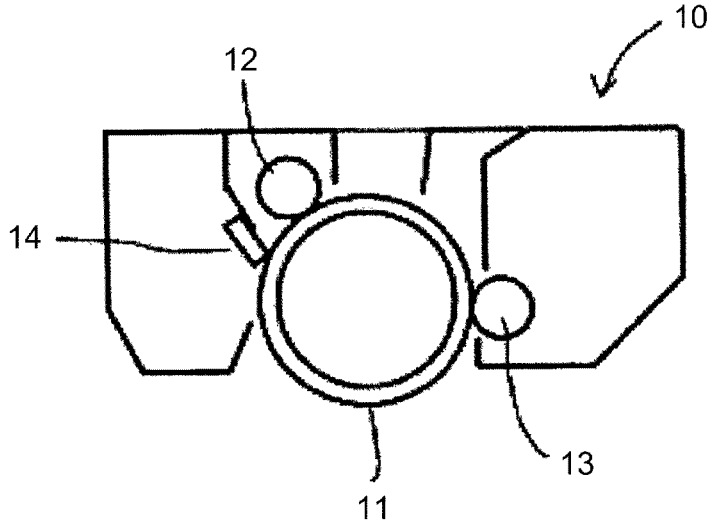

CARRIER FOR DEVELOPING ELECTROSTATIC LATENT IMAGE, TWO-COMPONENT DEVELOPER, DEVELOPER FOR REPLENISHMENT, IMAGE FORMING DEVICE, PROCESS CARTRIDGE, AND IMAGE FORMING METHOD

TECHNICAL FIELD

The present invention relates to a carrier for developing an electrostatic latent image, a two-component developer, a developer for replenishment, an image forming device, a process cartridge, and an image forming method.

BACKGROUND ART

In image formation using an electrophotography method, an electrostatic latent image is formed on an electrostatic latent image bearer made of a photoconductive material, a toner image is formed by applying charged toner to the electrostatic latent image, and then the resultant toner image is transferred to a recording medium and fixed to form an output image. In recent years, technologies such as copying machines and printers using the electrophotographic method are rapidly developing from those using a monochromatic electrophotographic method to those using a full-color electrophotographic method, and the market for technologies using the full-color electrophotographic method is increasing.

In full-color image formation, generally, three color toners of yellow, magenta, and cyan or four color toners of black as well as yellow, magenta, and cyan are laminated to reproduce all colors. Therefore, in order to obtain a sharp full-color image excellent in color-reproducibility, it is necessary to smooth the surface of a fixed toner image so as to reduce light scattering. For these reasons, image gloss obtained by means of conventional full-color copying machines and the like is often middle to high, that is, 10% to 50%.

In general, as a method for fixing a dry-toner image on a recording medium, a contact-heating fixing method is often employed in which a roller or belt having a smooth surface is press-contact with toner while heating the roller or belt. This method has advantages in that it exhibits high-thermal efficiency, enables high-speed fixing and enables color toner image to have glossiness and transparency. On the other hand, this method inconveniently causes a so-called offset phenomenon in which a part of a toner image adheres to the surface of a fixing roller and then is transferred onto another image, because a surface of a heat-fixing member is made in contact with a molten toner under application of pressure and then they separates from each other.

In order to prevent such an offset phenomenon, there has been carried out a method of forming a surface layer of a fixing roller with use of a material excellent in releasing property, such as a silicone rubber or a fluorine resin, and further applying a toner adhesion preventing oil, such as a silicone oil, onto the surface layer of the fixing roller. Although this method is extremely effective in preventing toner offset, this method requires additionally providing a device for supplying the oil, leading to upsizing of the fixing device.

As a result, in monochromatic image formation, an oil-less system in which a toner, which has a high viscoelasticity at the time of melting and contains a releasing agent in order to avoid internal fracture of the molten toner, is used to dispense with oil application onto a fixing roller, or a system in which the toner is used to make the application amount of oil very small is increasingly used.

Meanwhile, also in full-color image formation, an oil-less system tends to be employed for downsizing of a fixing device and simplification of the structure as well as in monochromatic image formation. In the full-color image formation, however, there is a need to smooth the surface of a fixed toner image, and thus to reduce the viscoelasticity of the toner in a molten state. Therefore, the full-color image formation can more easily cause the offset phenomenon than the monochromatic image formation, which produces less glossiness, and the full-color image formation becomes more difficult to employ the oil-less system. When the toner containing a release agent is used, the adhesive strength of the toner is increased, so that the transferability of the toner to a recording medium is degraded. Further, use of the toner containing the releasing agent disadvantageously causes toner filming, leading to degradation in chargeability and then in durability.

Meanwhile, a carrier, a surface of which is coated with a resin layer containing carbon black, is known as being a carrier designed to meet objectives, such as to prevent toner filming, form a uniform surface, prevent surface oxidation and degradation of moisture sensitivity, extend a lifetime of a developer, prevent adhesion onto the surface of a photoconductor, protect the photoconductor from being scratched and abrasion, control charge polarity, and adjust the charge amount. Such a carrier can form a good image at the beginning. However, the image quality is degraded due to abrasion of the resin layer as the number of copies increases. Further, color contamination occurs due to abrasion of the resin layer or separation of carbon black from the resin layer. As alternative materials for carbon black, there are generally known titanium oxide, zinc oxide, and the like. Those materials, however, do not provide a sufficient effect to lower the volume resistivity. In addition, the image may be disturbed due to resistance change caused by separation of fine particles contained in the resin layer by stress to cause exposure of a core material. To cope with this, PTL 1 discloses a technique in which the separation is reduced by dispersing conductive fine particles, which have a large shape factor SF-1 treated with an ionic liquid, in a resin layer to increase the adhesion area between the resin and the conductive fine particles.

In the field of production printing, for which the market is growing in recent years, higher image quality than ever is required. It is technically extremely difficult for a machine alone to cope with density fluctuation and density unevenness in an image on one sheet and density fluctuation among images in printing of tens of thousands of sheets. For this reason, there is a need to control the charge amount of toner in a constant level more than ever. The conventional carrier as described above, however, is not able to satisfy required properties. In recent years, toner tends to be fixed at a low temperature to reduce power consumption. In order to fix the toner at a low temperature, the amount of fine particles needs to be reduced. As a consequence, the toner is disadvantageously scattered due to insufficient charge of the toner caused by insufficient mixing of the toner with the developer at the time of replenishment. In a system in which the charging ability of the carrier mainly determines the charging ability of the toner, the charge imparting ability of the carrier is required to be maintained in a stable state from the beginning of printing until after printing tens of thousands of sheets.

SUMMARY OF INVENTION

Technical Problem

The present disclosure has an object to provide a carrier for developing an electrostatic latent image that has sufficient charging ability, is capable of supplying a stable amount of developer to a developing region, and is capable of providing an image quality required in the field of production printing even in a high-speed machine using a toner fixed at a low temperature.

Solution to Problem

According to one aspect of the present invention, a carrier for developing an electrostatic latent image includes a core material particle and a resin layer covering a surface of the core material particle. The resin layer includes a resin and at least one kind of a fine particle. At least one kind of the fine particles includes a chargeable fine particle. The chargeable fine particle has a long diameter of 400 to 900 nm. The chargeable fine particle has a shape factor SF-1 of 160 to 250.

Advantageous Effects of Invention

According to the present invention, the carrier for developing an electrostatic latent image that has sufficient charging ability, is capable of supplying a stable amount of developer to a developing region, and is capable of providing an image quality required in the field of production printing even in a high-speed machine using a toner fixed at a low temperature can be provided.

BRIEF DESCRIPTION OF DRAWINGS

FIG. 1 is a view for illustrating a cell for measuring the volume resistivity of the carrier for developing an electrostatic latent image according to the present invention.

FIG. 2 is a view illustrating one example of the process cartridge according to the present invention.

DESCRIPTION OF EMBODIMENTS

A carrier for developing an electrostatic latent image (hereinafter may simply referred to as a carrier) according to the present invention will be described in detail.

The carrier for developing an electrostatic latent image according to the present invention includes a core material particle and a resin layer covering the surface of the particle. The resin layer includes a resin and at least one kind of a fine particle. At least one kind of the fine particle is a chargeable fine particle. The chargeable fine particle has a long diameter of 400 to 900 nm. The chargeable fine particle has a shape factor SF-1 of 160 to 250.

The chargeable fine particles according to the present invention refer to fine particles exhibiting reverse chargeability with respect to the toner and impart, for example, negative chargeability to the toner through the friction with the toner. The charging is imparted by frictional contact with the toner and thus a part of the chargeable fine particles is preferably exposed on the surface of the resin layer. According to this form, not only is the charging ability improved but also the chargeability can be maintained even after the output of an image having a high image area for a long period of time. Examples of the chargeable fine particles in the case of imparting, for example, negative chargeability to the toner include barium sulfate, magnesium hydroxide, magnesium oxide, hydrotalcite, and zinc oxide. Among them, barium sulfate is preferable.

The long diameter of the chargeable fine particle is required to be 400 nm or larger and 900 nm or smaller. The long diameter is smaller than 400 nm, the charging ability of the carrier may not be stable. The reason of this includes that the chargeable fine particle is difficult to be exposed on the resin layer. From the viewpoint of improving the charging ability and developing capability, the long diameter of the chargeable fine particle is preferably 600 nm or larger. In contrast, the chargeable fine particle having a long diameter of larger than 900 nm is not preferable because the chargeable fine particle is likely to be separated from the resin layer.

The long diameter of the chargeable fine particles according to the present invention is measured by the following method.

The carrier is mixed in an embedding resin (manufactured by Devcon, Inc., a two-component mixing type epoxy resin cured for 30 minutes) and cured overnight. A rough section sample is prepared from the cured product by mechanical polishing. The section of the rough sample is finished by using a cross-section polisher (SM-09010, manufactured by JEOL Ltd.) under conditions of an acceleration voltage of 5.0 kV and a beam current of 120 μA. The section of the finished sample is photographed using a scanning electron microscope (Merlin, manufactured by Carl Zeiss AG) under conditions of an acceleration voltage of 0.8 kV and a magnification of 30,000 times. The photographed image is taken into a TIFF image. The long diameters of the chargeable fine particles of 100 particles are measured using Image-Pro Plus manufactured by Media Cybernetics Inc. and the average value of the long diameters is determined to be the long diameter of the chargeable fine particle according to the present invention.

According to the present invention, the shape factor SF-1 of the chargeable fine particle is required to be 160 or larger and 250 or smaller.

The shape factor SF-1 indicates the degree of sphericity. As the shape factor SF-1 increases from 140, the shape of the chargeable fine particle gradually changes from the spherical shape to a flat shape to an irregular shape. The chargeable fine particles having a shape factor SF-1 of 160 or larger are likely to expose on the surface of the resin layer and thus the sufficient charging ability to the carrier can be imparted. For example, when a resin layer is provided by spray coating, particularly by coating using a two-fluid nozzle, chargeable fine particles having a shape factor SF-1 of 160 or larger are likely to be parallel to the core material particle. It is conceivable that this phenomenon occurs because the chargeable fine particles follow the flow of the resin when the spray droplets are landed on the surfaces of the core material particle and smoothed. As a result, when the chargeable fine particles having a shape factor SF-1 of smaller than 160 are used, satisfactory charging ability is not developed unless the chargeable fine particles are exposed due to abrasion of the resin by printing stress. In contrast to this, when the chargeable fine particles having a shape factor SF-1 of 160 or larger are used, many chargeable fine particles are exposed on the carrier surface from the beginning of printing and thus a sufficient charging ability can be provided. If one wishes to increase the exposed surfaces of the fine particles from the beginning of printing in the case of using the chargeable fine particles having a shape factor SF-1 of smaller than 160, it is conceivable as a possible solution that the ratio of the particle size of the chargeable fine particles to a resin layer thickness is changed. In this case, however, the fine particles are likely to be separated due to decrease in the adhesion area between the resin and the chargeable fine particles. Another solution is to add a charging control agent. By adding the charging control agent, the initial charging ability can be secured by the charging control agent and the exposed surfaces of a part of the chargeable fine particles. However, when the resin layer is abraded by printing stress, the exposure amount of the chargeable fine particles is significantly changed, so that the charging amount distribution of the toner also fluctuates. As a result, the charging amount of the toner rapidly increases as the amount of printing increases and the color tone of the printed image becomes uneven, resulting in impairing the printing quality. According to the present invention, the chargeable fine particles having a shape factor SF-1 of 160 or larger are used. As a consequence, the fluctuation of the exposed area when the resin covering the chargeable fine particles is abraded becomes small and as a result, the stable chargeability can be exhibited.

In addition, the shape factor SF-1 of the chargeable fine particle is required to be 250 or smaller. When the chargeable fine particles having a shape factor SF-1 of larger than 250 is used, that is, when chargeable fine particles having a very high degree of flatness are used, the degree of sphericity is remarkably lost and the irregularities of the carrier surface become small and minute. The toner resin, wax, additives and the like are selectively spent into the recesses formed by the presence of the fine particles in the resin layer. However, when the irregularities are small and minute, the amount of spent in the recesses increases and the function of the recesses is impaired. Charging is decreased when the charging control agent is positioned in the recesses, whereas resistance is increased when a resistance control agent is positioned in the recesses.

According to the present invention, the shape factor SF-1 of the chargeable fine particle is more preferably 190 to 210.

The shape factor SF-1 according to the present invention is measured by the following method. By using a scanning electron microscope (S-800, manufactured by Hitachi, Ltd.), chargeable fine particle images are randomly sampled and the image information thereof is introduced to an image analyzer (Luzex3) manufactured by Nicolet Co., Ltd. through an interface and analyzed, followed by calculating the shape factor SF-1 using the following formula.

$$SF\text{-}1=((MXLNG)^2/AREA))(100\pi/4)$$

Herein, MXLNG indicates an absolute maximum length of the chargeable fine particle and AREA indicates a projected area of the chargeable fine particle.

According to the present invention, 100 chargeable fine particles are randomly sampled and the average value of the measured values was determined to be SF-1 according to the present invention.

It is important that the chargeable fine particles are contained in the resin layer. As described above, the charging ability of the carrier is sufficiently improved by exposing the chargeable fine particles on the surface layer of the carrier. However, if the surfaces of the chargeable fine particles are covered with a substance such as tin, a charging ability is not sufficiently ensured because the charged portions of the chargeable fine particles are not exposed on the surface layer. For this reason, the stable charging ability is difficult to be exhibited. Further, the exposure of the chargeable fine particles on the surface layer of the carrier provides the effect of easily capturing the replenished toner. It is conceivable that this phenomenon is caused by easily charging the chargeable fine particles and the toner through friction. Consequently, this phenomenon is extremely effective to the toner in which the charged particles are decreased for fixing at a low temperature. The chargeable fine particles may be partially covered with a substance such as tin. In this case, however, the coverage ratio of the chargeable fine particles relative to the surfaces is preferably lower than 10%.

The shape of the chargeable fine particles can be adjusted by appropriately adjusting the reaction conditions, such as a reaction rate and a stirring speed, at the time of producing the chargeable fine particles.

According to the present invention, the thickness of the resin layer is preferably 0.2 μm or thicker and 2.0 μm or thinner, whereby the advantageous effects of the present invention can be further improved. The chargeable fine particles having a thickness of the resin layer of 0.2 μm or thicker do not cause excessive exposure of the chargeable fine particles and do not provide excessively high charging ability of the carrier. Therefore, charging adjustment can be properly performed from the beginning of printing. In addition, the chargeable fine particles are difficult to be separated because sufficient contact surface areas between the chargeable fine particles and the resin can be obtained. Further, the chargeable fine particles having a thickness of the resin layer of 2.0 μm or thicker allow the toner to be sufficiently charged even when film abrasion does not proceed because the charged fine particles are appropriately exposed from the beginning of printing.

According to the present invention, the thickness of the resin layer is more preferably 0.4 μm or thicker and 1.5 μm or thinner.

The thickness of the resin layer according to the present invention is measured by the following method. The carrier is mixed in an embedding resin (manufactured by Devcon, Inc., a two-component mixing type epoxy resin cured for 30 minutes) and cured overnight. A rough section sample is prepared from the cured product by mechanical polishing. The section of the rough sample was finished by using a cross-section polisher (SM-09010, manufactured by JEOL Ltd.) under conditions of an acceleration voltage of 5.0 kV and a beam current of 120 μA. The section of the finished sample is photographed using a scanning electron microscope (Merlin, manufactured by Carl Zeiss AG) under conditions of an acceleration voltage of 0.8 kV and a magnification of 30,000 times. The photographed image is taken into a TIFF image. The thicknesses of the resin layer in a view field are measured using Image-Pro Plus manufactured by Media Cybernetics Inc. and the average value of the thicknesses is determined. Similarly, the thicknesses of the resin layers of 100 particles of carrier particles are measured and the average value thereof is determined to be the thickness of the resin layer according to the present invention.

The resin layer of the carrier according to the present invention preferably be obtained by hydrolyzing the following copolymer obtained by radical copolymerization of the following A and B components to form silanol groups, cross-linking by condensation using a catalyst, coating the surfaces of the core material particles, and thereafter subjecting the particles to heat treatment.

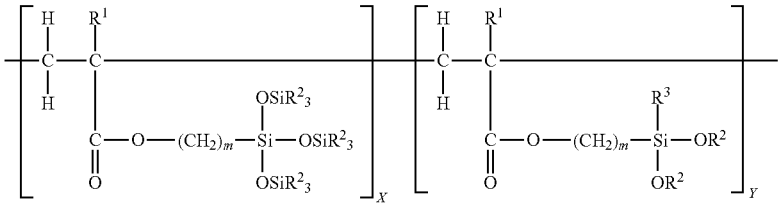

In the chemical formula, $R^1$, m, $R^2$, $R^3$, X, and y represent the followings.

$R^1$: a hydrogen atom or a methyl group m: an integer of 1 to 8

$R^2$: a hydrocarbon group having 1 to 4 carbon atoms, for example, an alkyl group such as a methyl group, an ethyl group, a propyl group, an isopropyl group, and a butyl group $R^3$: an alkyl group having 1 to 8 carbon atoms such as a methyl group, an ethyl group, a propyl group, an isopropyl group, and a butyl group, or an alkoxy group having 1 to 4 carbon atoms such as a methoxy group, an ethoxy group, a propoxy group, and a butoxy group.

A component:

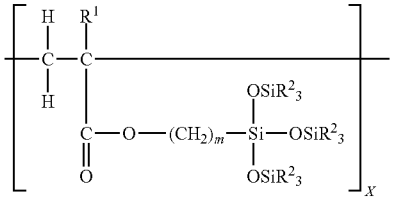

In the chemical formula, $R^1$, m, and $R^2$ are the same as described above.

For the A component, X is 10 mol % to 90 mol % and more preferably 30 mol % to 70 mol %.

For example, the A component has tris(trimethylsiloxy) silane, which is an atomic group in which a large number of methyl groups are present in the side chains. As the ratio of the A component increases relative to the whole resin, the surface energy decreases and thus adhesion of resin components and wax components in the toner is decreased. If the ratio of the A component is lower than 10 mol %, sufficient effect is not obtained and thus the adhesion of the toner component markedly increases. On the other hand, if the ratio of the A component is higher than 90 mol %, the B component B and the C component described below are decreased. Consequently, the cross-linking does not proceed and the toughness becomes insufficient as well as the adhesiveness between the core material particles and the resin layer decreases and the durability of the carrier coating film becomes poor.

$R^2$ is an alkyl group having 1 to 4 carbon atoms and examples of such a monomer component include tris(trialkylsiloxy)silane compounds represented by the following formulas.

In the formulas, Me, Et, and Pr refer to a methyl group, an ethyl group, and a propyl group, respectively.

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ A method for producing the A component is not particularly limited. The A component is obtained by a method of reacting tris(trialkylsiloxy)silane with allyl acrylate or allyl methacrylate in the presence of a platinum catalyst or a method for reacting methacryloxyalkylalkyltrialkoxysilane with hexaalkyldisiloxane in the presence of a carboxylic acid and an acid catalyst described in Japanese Unexamined Patent Application Publication No. H11-217389.

B component: (cross-linking component)

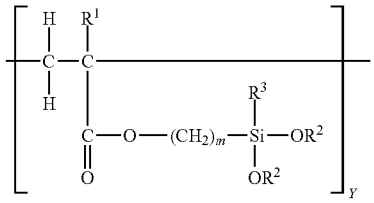

In the chemical formula, $R^1$, m, $R^2$, and $R^3$ are the same as described above.

Namely, the B component is a radically polymerizable bifunctional or trifunctional silane compound and Y is 10 mol % to 90 mol % and more preferably 30 mol % to 70 mol %. If the ratio of the B component is lower than 10 mol %, toughness is not sufficiently obtained. On the other hand, if the ratio of the B component is higher than 90 mol %, a hard and brittle coating film is generated and thus the coating film is likely to be abraded. In addition, environmental properties of the coating film deteriorate. It is conceivable that many hydrolyzed cross-linking components remain as silanol groups to deteriorate the environmental properties (humidity dependence).

Examples of such monomer components include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, and 3-acryloxypropyltri(isopropoxy) silane.

According to the present invention, an acrylic compound (a monomer) may be added as a C component in addition to the A component and the B component.

C component:

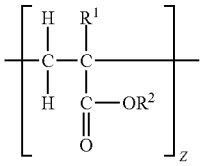

Examples of the copolymer in which such a C component is added include the following copolymer.

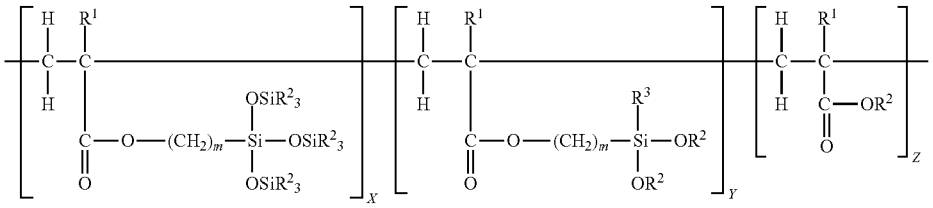

In the formula, $R^1$, m, $R^2$, and $R^3$ are the same as described above. X is 10 mol % to 40 mol %, Y is 10 mol % to 40 mol %, Z is 30 mol % to 80 mol %, and 60 mol %<Y+Z<90 mol %.

The C component gives flexibility to the resin layer and improves the adhesiveness between the core material particles and the resin layer. However, if the ratio of the C component is lower than 30 mol %, sufficient adhesiveness is not obtained. If the ratio of the C component is higher than 80 mol %, either the ratio of A component or the ratio of B component becomes 10 mol % or lower, and thus all of water repellency, hardness, and flexibility (film abrasion) of the resin layer are difficult to be satisfies at the same.

Preferable examples of the acrylic compound (the monomer) of the C component include acrylic acid esters and methacrylic acid esters and specific examples thereof include methyl methacrylate, methyl acrylate, ethyl methacrylate, ethyl acrylate, butyl methacrylate, butyl acrylate, 2-(dimethylamino)ethyl methacrylate, 2-(dimethylamino) ethyl acrylate, 3-(dimethylamino)propyl methacrylate, and 3-(dimethylamino)propyl acrylate. Among them, alkyl methacrylate is preferable, and methyl methacrylate is particularly preferable. These compounds may be used singly or in combination of two or more of them.

A technique for improving durability by cross-linking of the resin layer is described in Japanese Patent No. 3691115. Japanese Patent No. 3691115 has disclosed the technique of a carrier for developing electrostatic image in which the surfaces of magnetic particles are covered with a thermosetting resin obtained by cross-linking a copolymer of an organopolysiloxane having a vinyl group at least at an end thereof and a radical copolymerizable monomer having at least one functional group selected from the group consisting of a hydroxy group, an amino group, an amide group, and an imide group with an isocyanate compound. At present, however, durability in peeling/abrasion of the resin layer is not sufficiently obtained.

Although the reason for this is not clear enough, in the case of a thermosetting resin obtained by crosslinking the copolymer with the isocyanate compound, as can be seen from the structure formula, the amount of the functional group per unit weight reacting (cross-linking) with the isocyanate compound in the copolymer resin is small and thus two-dimensional or three-dimensional dense cross-linked structures is not be formed at the crosslinking points. For this reason, it is presumed that long time use of this carrier for developing electrostatic image is likely to cause peeling/abrasion of the resin layer (the abrasion resistance of the coating film is low) and thus durability is not sufficiently obtained.

Occurrence of the peeling/abrasion of the resin layer causes image quality change and carrier adhesion due to a decrease in carrier resistance. The peeling/abrasion of the resin layer reduces the fluidity of the developer and causes a reduction in the amount of drawn developer. Consequently, the peeling/abrasion of the resin layer causes reduction in image density, scumming due to an increase in TC, and toner scattering.

The resin used in the present invention is a copolymer having a large number of functional groups (points) capable of cross-linking being bifunctional or trifunctional per unit weight of resin (per unit weight, as many as two to three times) and is obtained by further crosslinking the copolymer by condensation polymerization. Therefore, it is conceivable that the coating film is very tough and hardly abraded and that, as a result, high durability is achieved.

Compared with cross-linking by an isocyanate compound, cross-link by siloxane bond according to the present invention is larger in bond energy and more stable to heat stress. Therefore, it is presumed that the stability of the resin layer over time is maintained.

As resins used in the resin layer according to the present invention, a silicone resin, an acrylic resin, or a combination thereof can be used in addition to the resins described above. The acrylic resin has strong adhesiveness and low brittleness and thus has a very excellent property of abrasion resistance. On the other hand, however, the acrylic resin may cause troubles such as decreasing the charging amount due to accumulation of toner component spent in the case of combination with a toner that is likely to spend because of high surface energy of the acrylic resin. In this case, this problem can be solved by using the silicone resin that is less likely to spend toner components because of low surface energy and can provide the effect of reducing the accumulation of spent components due to film abrasion with the acrylic resin. The silicone resin, however, has low adhesiveness and high brittleness, and thus also has a weak point of poor abrasion resistance and thus it is important to obtain the good balance of properties of these two resins. Consequently, these balanced properties allow the coating film having difficulty in accumulation of spent and having abrasion resistance to be obtained.

The silicone resin described in the present specification refers to all commonly known silicone resins and examples of the silicone resin includes a straight silicone resin consisting of organosiloxane bonds alone and modified silicone resins with alkyd, polyester, epoxy, acrylic, urethane, and the like. The silicone resin, however, is not limited to these examples. Examples of commercially available product of straight silicone resins include KR271, KR255, and KR152 manufactured by Shin-Etsu Chemical Co., Ltd. and SR2400, SR2406, and SR2410 manufactured by Dow Corning Toray Silicone Co., Ltd. In these cases, although the silicone resin alone can be used, the silicone resin can also be used with other components that can cause a cross-linking reaction and a charging amount adjusting component, and the like at the same time. Examples of the modified silicone resin include KR206 (alkyd modified), KR5208 (acrylic modified), ES1001N (epoxy modified), and KR305 (urethane modified) manufactured by Shin-Etsu Chemical Co., Ltd. and SR2115 (epoxy modified) and SR2110 (alkyd modified) manufactured by Dow Corning Toray Silicone Co., Ltd.

The resin layer according to the present invention preferably includes conductive fine particles in order to adjust the volume resistivity of the carrier. The conductive fine particles are not particularly limited. Examples of the conductive fine particles include carbon black, and fine particles of ITO, PTO, WTO, tin oxide, zinc oxide, and conductive polymers such as polyaniline. These conductive fine particles can be used in combination of two or more of them.

The carrier according to the present invention preferably has a volume average particle size of 28 to 40 μm. The carrier particles having a volume average particle size of smaller than 28 μm may cause carrier adhesion, whereas the carrier particles having a volume average particle size of larger than 40 μm causes decrease in reproducibility of the image detail and may fail to form fine images.

The volume average particle size can be measured using, for example, Microtrac Particle Size Distribution Meter model HRA 9320-X100 (manufactured by NIKKISO CO., LTD.).

The carrier according to the present invention preferably has a volume resistivity of 8 to 16 (Log Ω·cm). The carrier having a volume resistivity of lower than 8 (Log Ω·cm) may cause carrier adhesion in the non-image area, whereas the carrier having a volume resistivity of higher than 16 (Log Ω·cm) may result in unacceptable level of an edge effect.

The volume resistivity can be measured by using a cell illustrated in FIG. 1. Specifically, first, the carrier 3 is filled in the cell made of a fluorine resin container 2 containing an electrode 1*a* and an electrode 1*b* having a surface area of 2.5 cm×4 cm at a distance of 0.2 cm, and then tapped ten times at a tapping speed of 30 times/min from a dropping height of 1 cm. Subsequently, direct voltage of 1,000 V was applied between the electrodes 1*a* and 1*b*, and the resistance r [Ω] after 30 seconds of application was measured by using a high-resistance meter 4329A (manufactured by Yokogawa Hewlett Packard, Co., Ltd.). The volume resistivity [Ω·cm] can be calculated from the following formula.

$$r\cdot(2.5\cdot4)/0.2$$

Examples of the polycondensation catalyst include titanium-based catalysts, tin-based catalysts, zirconium-based catalysts, and aluminum-based catalysts. According to the present invention, among these catalysts, titanium diisopropoxy bis(ethylacetoacetate) is the most preferable catalyst among the titanium-based catalysts that provide excellent results. It is conceivable that this is because this catalyst is highly effective for promoting the condensation reaction of the silanol group and is difficult to be deactivated.

According to the present invention, when the silicone resin is used for the resin layer, a silane coupling agent is preferably used in combination with the silicone resin. This combination allows the fine particles to be stably dispersed.

The silane coupling agent is not particularly limited. Examples of the silane coupling agent include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl[3-(trimethoxysilyl)propyl]ammonium chloride, γ-chloropropylmethyldimethoxysilane, methyltrichlorosilane, dimethyldichlorosilane, trimethylchlorosilane, allyltriethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl) ammonium chloride. These silanes may be used in combination of two or more of them.

Examples of the commercially available products of the silane coupling agents include AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z-6341, AY43-210MC, AY43-083, AY43-101, AY43-013, AY43-158E, Z-6920, and Z-6940 (manufactured by Toray Silicone Co., Ltd.).

The addition amount of silane coupling agent is preferably 0.1% by mass to 10% by mass relative to silicone resin. When the addition amount of silane coupling agent is lower than 0.1% by mass, adhesiveness between the core material particles and fine particles and the silicone resin lowers, and thus the resin layer falls off sometimes during use for a long period of time, whereas when the addition amount of silane coupling agent is higher than 10% by mass, filming of the toner occurs sometimes during use for a long period of time.

According to the present invention, the core material particles are not particularly limited so long as the particles are magnetic materials. Examples of the magnetic substances include ferromagnetic metals such as iron and cobalt; iron oxides such as magnetite, hematite, and ferrite; various alloys and compounds; and resin particles in which these magnetic substances are dispersed in a resin. Among them, Mn-based ferrite, Mn—Mg-based ferrite, Mn—Mg—Sr-based ferrite, and the like are preferable from the viewpoint of environmental care.

According to the present invention, the chargeable fine particles are preferably used in an amount of 40% by mass to 220% by mass and more preferably 80% by mass to 140% by mass relative to the resin.

The two-component developer according to the present invention (hereinafter, may be referred to as a developer) has the carrier and the toner according to the present invention.

The toner contains a binder resin and a colorant and may be either a monochrome toner or a color toner. In order to apply to an oil-less system in which oil for preventing toner adhesion is not applied to a fixing roller, the toner particles may contain a release agent. Generally, such a toner is likely to cause filming. The carrier according to the present invention, however, can reduce filming and thus the developer according to the present invention can maintain good quality for a long period of time. The color toners, in particular yellow toners, generally have the problem of generating color contamination due to abrasion of the coating layer of the carrier. The developer according to the present invention, however, can reduce the generation of the color contamination.

Toner can be produced using known methods such as a pulverization method or a polymerization method. For example, when the toner is produced using the pulverization method, first, a melt-kneaded material obtained by kneading toner raw materials is cooled, and then pulverized and classified to prepare base particles. Subsequently, in order to further improve transferability and durability, an external additive is added to the base particles to prepare the toner.

Examples of the apparatus for kneading the toner materials at this time include, but are not limited to, batch type two rolls; a Banbury mixer; continuous twin-screw extruders such as a KTK type twin-screw extruder (manufactured by Kobe Steel Ltd.), a TEM type twin-screw extruder (manufactured by Toshiba Machine Co., Ltd), a twin-screw extruder (manufactured by ASADA IRON WORKS. CO., LTD.), a PCM type twin-screw extruder (manufactured by IKEGAI IRON WORKS CO., LTD.), and a KEX type twin-screw extruder (manufactured by KURIMOTO, LTD.); and continuous type single screw kneaders such as a co-kneader (manufactured by BUSS AG.).

In pulverizing a cooled melt-kneaded material, the cooled melt-kneaded material can be coarsely pulverized using a hammer mill, Rotoplex, or the like, then, can be finely pulverized using a fine pulverizer using a jet air stream, a mechanical type pulverizer, or the like. The cooled melt-kneaded material is preferably pulverized so that the pulverized melt-kneaded material has an average particle size of 3 μm to 15 μm.

The pulverized melt-kneaded material can be classified using a pneumatic separator or the like. The pulverized melt-kneaded material is preferably classified so that the average particle size of the base particles is 5 μm to 20 μm.

At the time of adding the external additive to the base particles, the external additive adheres to the surfaces of the base particles with the external additive being disintegrated by mixing and stirring using mixers.

The binder resin is not particularly limited. Examples of the binder resin include homopolymers of styrene and substitution products thereof such as polystyrene, polypstyrene, and polyvinyltoluene; styrene-based copolymers such as a styrene-p-chlorostyrene copolymer, a styrene-propylene copolymer, a styrene-vinyltoluene copolymer, a styrene-methyl acrylate copolymer, a styrene-ethyl acrylate copolymer, a styrene-methacrylic acid copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ether copolymer, a styrene-vinyl methyl ketone copolymer, a styrene-butadiene copolymer, a styrene-isoprene copolymer, and a styrene-maleic acid ester copolymer; polymethyl methacrylate, polybutyl methacrylate, polyvinyl chloride, polyvinyl acetate, polyethylene, polyester, polyurethane, an epoxy resin, polyvinyl butyral, polyacrylic acid, rosin, modified rosin, a terpene resin, a phenolic resin, an aliphatic or aromatic hydrocarbon resin, and an aromatic petroleum resin. These binder resins may be used in combination of two or more of them.

The binder resin for pressure fixing is not particularly limited. Examples of the binder resin for pressure fixing include polyolefins such as a low molecular weight polyethylene or a low molecular weight polypropylene; olefin copolymers such as an ethylene-acrylic acid copolymer, an ethylene-acrylic acid ester copolymer, a styrene-methacrylic acid copolymer, an ethylene-methacrylic acid ester copolymer, an ethylene-vinyl chloride copolymer, an ethylene-vinyl acetate copolymer, and an ionomer resin; an epoxy resin, polyester, a styrene-butadiene copolymer, polyvinyl pyrrolidone, a methyl vinyl ether-maleic anhydride copolymer, a maleic acid-modified phenolic resin, and a phenol-modified terpene resin. These the binder resin for pressure fixing can be used in combination of two or more of them.

The colorant (pigment or dye) is not particularly limited. Examples of the colorant include yellow pigments such as cadmium yellow, mineral fast yellow, nickel titanium yellow, navel yellow, naphthol yellow S, Hansa yellow G, Hansa yellow 10G, benzidine yellow GR, quinoline yellow lake, permanent yellow NCG, and tartrazine lake; orange pigments such as molybdenum orange, permanent orange GTR, pyrazolone orange, Vulcan orange, indanthrene brilliant orange RK, benzidine orange G, and indanthrene brilliant orange GK; red pigments such as iron oxide red, cadmium red, permanent red 4R, lithol red, pyrazolone red, watching red calcium salt, lake red D, brilliant carmine 6B, eosin lake, rhodamine lake B, alizarin lake, and brilliant carmine 3B; violet pigments such as fast violet B and methyl violet lake; blue pigments such as cobalt blue, alkali blue, Victoria blue lake, phthalocyanine blue, metal free phthalocyanine blue, partially chlorinated phthalocyanine blue, fast sky blue, and indanthrene blue BC; green pigments such as chrome green, chromium oxide, pigment green B, and malachite green lake; and black pigments such as carbon black, oil furnace black, channel black, lamp black, acetylene black, azine-based pigments such as aniline black, metal salt azo dyes, metal oxides, and complex metal oxides. These colorants can be used in combination of two or more.

The release agent is not particularly limited. Examples of the release agent include polyolefins such as polyethylene and polypropylene, metal salts of fatty acids, fatty acid esters, paraffin wax, amide wax, polyhydric alcohol wax, silicone varnish, carnauba wax, and ester wax. These release agents can be used in combination of two or more of them.

The toner may further contain a charging control agent. The charging control agent is not particularly limited. Examples of the charging control agent include nigrosine; azine-based dyes having an alkyl group having 2 to 16 carbon atoms (refer to Japanese Examined Patent Application Publication No. S42-1627); basic dyes such as C.I.Basic Yellow 2 (C.I.41000), C.I.Basic Yellow 3, C.I.Basic Red 1 (C.I.45160), C.I.Basic Red 9 (C.I.42500), C.I.Basic Violet 1 (C.I.42535), C.I.Basic Violet 3 (C.I.42555), C.I.Basic Violet 10 (C.I.45170), C.I.Basic Violet 14 (C.I.42510), C.I.Basic Blue 1 (C.I.42025), C.I.Basic Blue 3 (C.I.51005), C.I.Basic Blue 5 (C.I.42140), C.I.Basic Blue 7 (C.I.42595), C.I.Basic Blue 9 (C.I.52015), C.I.Basic Blue 24 (C.I.52030), C.I.Basic Blue 25 (C.I.52025), C.I.Basic Blue 26 (C.I.44045), C.I.Basic Green 1 (C.I.42040), and C.I.Basic Green 4 (C.I.42000); lake pigments of these basic dyes; quaternary ammonium salts such as C.I.Solvent Black 8 (C.I.26150), benzoylmethylhexadecylammonium chloride, and decyltrimethylchloride; dialkyl tin compounds such as dibutyl tin and dioctyl tin; dialkyl tin borate compounds; guanidine derivatives; polyamine resins such as vinyl polymers having amino groups and condensation polymers having amino groups; metal complex salts of monoazo dyes described in Japanese Examined Patent Application Publication No, S41-20153, Japanese Examined Patent Application Publication No. S43-27596, Japanese Examined Patent Publication No. S44-6397, and Japanese Examined Patent Publication No. S45-26478; salicylic acids described in Japanese Examined Patent Publication No. S55-42752 and Japanese Examined Patent Publication No. S59-7385; metal complexes of Zn, Al, Co, Cr, Fe, and the like of dialkyl salicylic acids, naphthoic acids, and dicarboxylic acids; sulfonated copper phthalocyanine pigments; organic boron salts; fluorine-containing quaternary ammonium salts; and calixarene compounds. These charging control agents can be used in combination of two or more of them. For the color toners other than black, a white metal salt of salicylic acid derivatives or the like is preferable.

The external additive is not particularly limited. Examples of the external additive include inorganic particles such as silica, titanium oxide, alumina, silicon carbide, silicon nitride, and boron nitride; and resin particles such as polymethyl methacrylate particles and polystyrene particles having an average particle size of 0.05 μm to 1 μm obtained by a soap-free emulsion polymerization method. These external additives can be used in combination of two or more of them. Among them, the metal oxide particles such as silica and titanium oxide having surfaces hydrophobically treated are preferable. The toner having excellent charging stability can be obtained by using both silica subjected to hydrophobic treatment and titanium oxide subjected to hydrophobic treatment and adding the higher amount of the titanium oxide subjected to hydrophobic treatment than the amount of the silica subjected to hydrophobic treatment.

The carrier according to the present invention is used as a developer for replenishment made of the carrier and the toner, and the developer for replenishment is applied to an image forming device that forms images while discharging a surplus developer in the developing device, whereby stable image quality can be obtained for an extremely long period of time. Namely, the deteriorated carrier in the developing device is replaced by the non-deteriorated carrier in the developer for replenishment, and thus the charging amount is stably maintained for a long period of time and stable images can be obtained. This method is particularly effective at the time of high image area printing. At the time of printing an image having a high image area, carrier charge deterioration due to toner spent on the carrier is the main carrier degradation. By using this method, however, the amount of the replenished carrier also increases at the time of printing an image having a high image area and thus the frequency of interchange of the deteriorated carrier increases. This allows stable images to be obtained for an extremely long period of time.

The mixing ratio of the developer for replenishment is preferably a ratio of 2 parts by mass to 50 parts by mass of the toner to be added relative to 1 part by mass of the carrier. When the toner is less than 2 parts by mass, the amount of the replenishment carrier is too much, resulting in an excess supply of carrier. This results in an excessive carrier concentration in the developing device and thus the charging amount of the developer is likely to increase. In addition, as the charging amount of developer increases, the developing capability decreases and the image density decreases. When the toner is more than 50 parts by mass, the ratio of carrier in the developer for replenishment becomes small, and thus the interchange of carrier in the image forming device is reduced. Consequently, the effect against carrier deterioration cannot be expected.

(Image Forming Method)

The image forming method according to the present invention includes forming an electrostatic latent image on an electrostatic latent image bearer, developing the electrostatic latent image formed on the electrostatic latent image bearer with the developer according to the present invention to form a toner image, transferring a toner image formed on the electrostatic latent image bearer to a recording medium, and fixing the toner image transferred to the recording medium.

(Image Forming Device)

The image forming device according to the present invention includes an electrostatic latent image bearer, a charging unit that charges the latent image bearer, an exposure unit that forms an electrostatic latent image on the latent image bearer, a developing unit that develops the electrostatic latent image formed on the electrostatic latent image bearer with a developer to form a toner image, a transfer unit that transfers the toner image formed on the electrostatic latent image bearer to a recording medium, and a fixing unit that fixes the toner image transferred to the recording medium. The image forming device further includes other units such as a static elimination unit, a cleaning unit, a recycling unit, and a control unit, if necessary. The image forming device uses the developer according to the present invention as the developer.

In FIG. 2, one example of a process cartridge according to the present invention is illustrated. The process cartridge 10 integrally supports a photoconductor 11 as an electrostatic latent image bearer, a charging unit 12 that charges the photoconductor 11, a developing unit 13 that develops the electrostatic latent image formed on the photoconductor 11 using the developer according to the present invention to form a toner image, and, after transferring the toner image formed on the photoconductor 11 to a recording medium, a cleaning unit 14 that cleans the toner remaining on the photoconductor 11. The process cartridge 10 is attachable to and detachable from a main body of image forming devices such as a copying machine and a printer.

Hereinafter, a method for forming an image using the image forming device in which the process cartridge 10 is mounted will be described. First, the photoconductor 11 is rotationally driven at a predetermined peripheral speed and the peripheral surface of the photoconductor 11 is uniformly charged to a predetermined positive or negative potential by the charging unit 12. Subsequently, the peripheral surface of the photoconductor 11 is irradiated with exposure light from an exposure device (not illustrated) such as a slit exposure-type exposure device or an exposure device that performs scanning and exposure with laser beam, to form an electrostatic latent image. In addition, the electrostatic latent image formed on the peripheral surface of the photoconductor 11 is developed by the developing unit 13 using the developer according to the present invention to form a toner image. Subsequently, the toner image formed on the peripheral surface of the photoconductor 11 is sequentially transferred to a transfer paper being synchronized with the rotation of the photoconductor 11 and fed from a sheet feeding unit (not illustrated) to a location between the photoconductor 11 and a transfer device (not illustrated). The transfer paper to which the toner image is transferred is separated from the peripheral surface of the photoconductor 11 to be introduced into a fixing device (not illustrated) and the toner image is fixed. Thereafter, the transfer paper is printed out from the image forming device to the outside as a copy. The surface of the photoconductor 11 after the toner image is transferred is cleaned by removing the remaining toner with the cleaning unit 14. Thereafter, the charging is eliminated by a neutralizer (not illustrated) and the surface of the photoconductor 11 is repeatedly used for forming images.

EXAMPLES

Hereinafter, the present invention will be described more specifically with reference to Examples and Comparative Examples. The present invention, however, is not limited to Examples. Here, a "part" means a part by mass.

Resin Synthesis Example 1

In a flask equipped with a stirrer, 300 g of toluene was placed and the temperature was raised to 90° C. under a nitrogen gas flow. Subsequently, a mixture of 84.4 g (200 mmol: SILAPLANE TM-0701T, manufactured by Chisso Corporation) of 3-methacryloxypropyltris(trimethylsiloxy) silane represented by $CH_2{=}CMe\text{-}COO{-}C_3H_6{-}Si(OSiMe_3)_3$ (wherein Me is a methyl group), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutyronitrile was added dropwise over 1 hour. After completion of the dropwise addition, a solution in which 0.06 g (0.3 mmol) of 2,2'-azobis-2-methylbutyronitrile is dissolved in 15 g of toluene was further added (the total amount of 2,2'-azobis-2-methylbutyronitrile of 0.64 g=3.3 mmol) and the resultant mixture was mixed at 90° C. to 100° C. for 3 hours and radically copolymerized to give Methacrylic Copolymer R1.

Carrier Production Example 1

20 parts of Methacrylic Copolymer R1 having a weight average molecular weight of 35,000 obtained in Synthesis Example 1 [solid content 100% by mass], 100 parts of a silicone resin solution [solid content 20% by mass], 3.0 parts of an aminosilane [solid content 100% by mass], 36 parts of barium sulfate fine particles (BARIACE B-55, manufactured by Sakai Chemical Industry Co., Ltd., long diameter 600 nm, and SF-1 195) and 60 parts of oxygen-deficient tin fine particles (manufactured by MITSUI MINING & SMELTING CO., LTD., primary particle size 30 nm) as fine particles, and 2 parts of titanium diisopropoxybis(ethylacetoacetate) TC-750 (manufactured by Matsumoto Fine Chemical Co., Ltd.) as a catalyst were diluted with toluene to give a resin solution having a solid content of 20% by mass.

Using Mn ferrite particles having a weight average particle size of 35 μm as core material particles, the resin solution was applied to the core material particles and dried using an atomization nozzle in a fluidized bed type coating device and controlling the temperature of the inside of the fluidized to 60° C. so that the average film thickness of the resin layer on the surfaces of the core material particles is 1.00 μm. The obtained carrier was baked in an electric furnace at 210° C. for 1 hour to give Carrier 1.

Carrier Production Example 2

Carrier 2 corresponding to Carrier Production Example 2 was obtained by exactly the same manner as Carrier Production Example 1 except that SF-1 of the barium sulfate fine particle was changed to 250.

Carrier Production Example 3

Carrier 3 corresponding to Carrier Production Example 3 was obtained by exactly the same manner as Carrier Production Example 1 except that SF-1 of the barium sulfate fine particle was changed to 210.

Carrier Production Example 4

Carrier 4 corresponding to Carrier Production Example 4 was obtained by exactly the same manner as Carrier Production Example 1 except that SF-1 of the barium sulfate fine particle was changed to 170.

Carrier Production Example 5

Carrier 5 corresponding to Carrier Production Example 5 was obtained by exactly the same manner as Carrier Production Example 1 except that SF-1 of the barium sulfate fine particle was changed to 160.

Carrier Production Example 6

Carrier 6 corresponding to Carrier Production Example 6 was obtained by exactly the same manner as Carrier Production Example 1 except that the long diameter of the barium sulfate fine particles was changed to 900 nm.

Carrier Production Example 7

Carrier 7 corresponding to Carrier Production Example 7 was obtained by exactly the same manner as Carrier Production Example 1 except that the long diameter of the barium sulfate fine particles was changed to 700 nm.

Carrier Production Example 8

Carrier 8 corresponding to Carrier Production Example 8 was obtained by exactly the same manner as Carrier Production Example 1 except that the long diameter of the barium sulfate fine particles was changed to 500 nm.

Carrier Production Example 9

Carrier 9 corresponding to Carrier Production Example 9 was obtained by exactly the same manner as Carrier Production Example 1 except that the long diameter of the barium sulfate fine particles was changed to 400 nm.

Carrier Production Example 10

Carrier 10 corresponding to Carrier Production Example 10 was obtained by exactly the same manner as Carrier Production Example 1 except that the long diameter and SF-1 of the barium sulfate fine particles was changed to 900 nm and 250, respectively.

Carrier Production Example 11

Carrier 11 corresponding to Carrier Production Example 11 was obtained by exactly the same manner as Carrier Production Example 1 except that the long diameter and SF-1 of the barium sulfate fine particles were changed to 400 nm and 250, respectively.

Carrier Production Example 12

Carrier 12 corresponding to Carrier Production Example 12 was obtained by exactly the same manner as Carrier Production Example 1 except that the long diameter and SF-1 of the barium sulfate fine particles were changed to 900 nm and 160, respectively.

Carrier Production Example 13

Carrier 13 corresponding to Carrier Production Example 13 was obtained by exactly the same manner as Carrier Production Example 1 except that the long diameter and SF-1 of the barium sulfate fine particles were changed to 400 nm and 160, respectively.

Carrier Production Example 14

Carrier 14 corresponding to Carrier Production Example 14 was obtained by exactly the same manner as Carrier Production Example 1 except that the barium sulfate fine particles were replaced by magnesium hydroxide (manufactured by Sakai Chemical Industry Co., Ltd., long diameter 600 nm, SF-1 195).

Carrier Production Example 15

Carrier 15 corresponding to Carrier Production Example 15 was obtained by exactly the same manner as Carrier Production Example 1 except that the barium sulfate fine particles were replaced by magnesium oxide (manufactured by Sakai Chemical Industry Co., Ltd., long diameter 600 nm, SF-1 195).

Carrier Production Example 16

Carrier 16 corresponding to Carrier Production Example 16 was obtained by exactly the same manner as Carrier Production Example 1 except that barium sulfate fine particles were replaced by hydrotalcite (manufactured by Sakai Chemical Industry Co., Ltd., long diameter 600 nm, SF-1 195).

Carrier Production Example 17

Carrier 17 corresponding to Carrier Production Example 17 was obtained by exactly the same manner as Carrier Production Example 1 except that barium sulfate fine particles were replaced by zinc oxide (manufactured by Sakai Chemical Industry Co., Ltd., long diameter 600 nm, SF-1 195).

Carrier Production Example 18

Carrier 18 corresponding to Carrier Production Example 18 was obtained by exactly the same manner as Carrier Production Example 1 except that the amounts were changed to 4 parts of Methacrylic Copolymer R1, 20 parts of the silicone resin solution, 0.6 parts of the aminosilane, 12 parts of the oxygen-deficient tin fine particles, and 0.4 parts of TC-750. In this Example, the thickness of the resin layer on the surfaces of the core material particles is set to 0.2 μm.

Carrier Production Example 19

Carrier 19 corresponding to Carrier Production Example 19 was obtained by exactly the same manner as Carrier Production Example 1 except that the amounts were changed to 6 parts of Methacrylic Copolymer R1, 30 parts of the silicone resin solution, 0.9 parts of the aminosilane, 18 parts of the oxygen-deficient tin fine particles, and 0.6 parts of TC-750. In this Example, the thickness of the resin layer on the surfaces of the core material particles is set to 0.3 μm.

Carrier Production Example 20

Carrier 20 corresponding to Carrier Production Example 20 was obtained by exactly the same manner as Carrier Production Example 1 except that the amounts were changed to 40 parts of Methacrylic Copolymer R1, 200 parts of the silicone resin solution, 6.0 parts of the aminosilane, 120 parts of the oxygen-deficient tin fine particles, and 4.0 parts of TC-750. In this Example, the thickness of the resin layer on the surfaces of the core material particles is set to 2.0 μm.

Carrier Production Example 21

Carrier 21 corresponding to Carrier Production Example 21 was obtained by exactly the same manner as Carrier Production Example 1 except that the amounts were changed to 44 parts of Methacrylic Copolymer R1, 220 parts of the silicone resin solution, 6.6 parts of the aminosilane, 132 parts of the oxygen-deficient tin fine particles, and 4.4 parts of TC-750. In this Example, the thickness of the resin layer on the surfaces of the core material particles is set to 2.2 μm.

Carrier Production Comparative Example 1

Carrier 22 corresponding to Carrier Production Comparative Example 1 was obtained by exactly the same manner as Carrier Production Example 1 except that SF-1 of the barium sulfate fine particle was changed to 260.

Carrier Production Comparative Example 2

Carrier 23 corresponding to Carrier Production Comparative Example 2 was obtained by exactly the same manner as Carrier Production Example 1 except that SF-1 of the barium sulfate fine particle was changed to 150.

Carrier Production Comparative Example 3

Carrier 24 corresponding to Carrier Production Comparative Example 3 was obtained by exactly the same manner as Carrier Production Example 1 except that the long diameter of the barium sulfate fine particles was changed to 1,000 nm.

Carrier Production Comparative Example 4

Carrier 25 corresponding to Carrier Production Comparative Example 4 was obtained by exactly the same manner as Carrier Production Example 1 except that the long diameter of the barium sulfate fine particles was changed to 300 nm.

Carrier Production Comparative Example 5

Carrier 26 corresponding to Carrier Production Comparative Example 5 was obtained by exactly the same manner as Carrier Production Example 1 except that the barium sulfate fine particles were replaced by tin oxide-coated barium sulfate (manufactured by Sakai Chemical Industry Co., Ltd., long diameter 600 nm, SF-1 195).

<Production Example of Toner>

—Synthesis of Polyester Resin A—

Into a reaction vessel equipped with a condenser, a stirrer, and a nitrogen introducing tube, 65 parts of ethylene oxide 2-mol adduct of bisphenol A, 86 parts of propylene oxide 3-mol adduct of bisphenol A, 274 parts of terephthalic acid, and 2 parts of dibutyltin oxide were charged and the mixture was reacted at 230° C. for 15 hours under normal pressure. Subsequently, the mixture was reacted for 6 hours under reduced pressure of 5 mmHg to 10 mmHg to synthesize a polyester resin. The obtained Polyester Resin A had a number average molecular weight (Mn) of 2,300, a weight average molecular weight (Mw) of 8,000, a glass transition temperature (Tg) of 58° C., an acid value of 25 mg KOH/g, and a hydroxy value of 35 mg KOH/g.

—Synthesis of Prepolymer (Polymer Capable of Reacting with Active Hydrogen Group-Containing Compound)—

Into a reaction container equipped with a condenser, a stirrer, and a nitrogen introducing tube, 682 parts by mass of ethylene oxide 2-mol adduct of bisphenol A, 81 parts by mass of propylene oxide 2-mol adduct of bisphenol A, 283 parts by mass of terephthalic acid, 22 parts by mass of trimellitic anhydride, and 2 parts by mass of dibutyltin oxide were charged and the mixture was reacted at 230° C. for 8 hours under normal pressure. Subsequently, the mixture was reacted for 5 hours under reduced pressure of 10 mmHg to 15 mmHg to synthesize an intermediate polyester resin.

The obtained intermediate polyester had a number average molecular weight (Mn) of 2,100, a weight average molecular weight (Mw) of 9,600, a glass transition temperature (Tg) of 55° C., an acid value of 0.5, and a hydroxy value of 49.

Subsequently, into a reaction container equipped with a condenser, a stirrer, and a nitrogen introducing tube, 411 parts by mass of the intermediate polyester, 89 parts by mass of isophorone diisocyanate, and 500 parts by mass of ethyl acetate were charged and the mixture was reacted at 100° C. for 5 hours to synthesize a prepolymer (the polymer capable of reacting with an active hydrogen group-containing compound).

The obtained prepolymer had a free isocyanate content of 1.60% by mass and a solid content concentration of the prepolymer (after being left to stand at 150° C. for 45 minutes) of 50% by mass.

—Synthesis of Ketimine (the Active Hydrogen Group-Containing Compound)—

Into a reaction container equipped with a stirring rod and a thermometer, 30 parts by mass of isophorone diamine and 70 parts by mass of methyl ethyl ketone were charged and the mixture was reacted at 50° C. for 5 hours to synthesize a ketimine compound (the active hydrogen group-containing compound). The obtained ketimine compound (the active hydrogen group-containing compound) had an amine value of 423.

—Preparation of Masterbatch—

Using a Henschel mixer (manufactured by Mitsui Mining Co., Ltd.), 1,000 parts of water, 540 parts of carbon black Printex 35 (manufactured by Degussa AG) having a DBP oil absorption amount of 42 mL/100 g and a pH of 9.5, and 1,200 parts of Polyester Resin A were mixed. Subsequently, the obtained mixture was kneaded using two rolls at 150° C. for 30 minutes, and thereafter rolled and cooled. The cooled sheet was pulverized with a pulverizer (manufactured by Hosokawa Micron Corporation) to prepare a master batch.

—Preparation of Aqueous Medium—

306 parts of ion-exchanged water, 265 parts of a 10% by mass suspension liquid of tricalcium phosphate, and 1.0 part of sodium dodecylbenzenesulfonate were mixed and stirred to homogeneously dissolve the mixture to prepare an aqueous medium.

—Measurement of Critical Micelle Concentration—

The critical micelle concentration of a surfactant was measured by the following method. Analysis was carried out using an analysis program in Sigma system using a surface tension meter Sigma (manufactured by KSV Instruments Ltd.). The surfactant was added dropwise in an amount of 0.01% by weight relative to the aqueous medium and the interfacial tension after stirring and being left to stand was measured. The surfactant concentration at which the interfacial tension did not decrease by dropwise addition of the surfactant was determined to be the critical micelle concentration, using the obtained surface tension curve. The critical micelle concentration of sodium dodecylbenzenesulfonate relative to the aqueous medium was measured with a surface tension meter Sigma and found to be 0.05 wt % relative to the weight of the aqueous medium.

—Preparation of Toner Material Liquid—

In a beaker, 70 parts of Polyester Resin A, 10 parts by mass of the prepolymer and 100 parts of ethyl acetate were charged and dissolved with stirring. To the solution, 5 parts of paraffin wax (HNP-9, melting point 75° C., manufactured by Nippon Seiro Co., Ltd.) as a release agent, 2 parts of MEK-ST (manufactured by Nissan Chemical Industries, Ltd.), and 10 parts of the master batch were added. The resultant mixture was treated three times with Ultra Visco Mill (AIMEX CO., Ltd.) being a bead mill under conditions of a liquid feed rate of 1 kg/hour, a peripheral speed of the disk of 6 m/sec, and a filing rate of 80% by volume of the zirconia beads having a particle size of 0.5 mm. Thereafter, 2.7 parts by mass of the ketimine was added and dissolved to prepare a toner material liquid.

—Preparation of Emulsion or Dispersion Liquid—

Into a container, 150 parts by mass of the aqueous medium was charged and stirred using a TK-type homomixer (manufactured by Tokushu Kika Kogyo Co., Ltd.) at a rotation speed of 12,000 rpm. To this aqueous medium, 100 parts by mass of the toner material dissolution liquid or dispersion liquid was added and the resultant mixture was mixed for 10 minutes to prepare an emulsion or dispersion liquid (emulsified slurry).

—Removal of Organic Solvent—

In a flask equipped with a stirrer and a thermometer, 100 parts by mass of the emulsified slurry was charged and desolvated at 30° C. for 12 hours while stirring at a stirring peripheral speed of 20 m/minute.

—Washing—

100 parts by mass of the emulsified slurry was filtrated under reduced pressure. Thereafter, 100 parts by mass of ion-exchanged water was added to the filter cake and the resultant mixture was mixed by the TK-type homomixer (at a rotation speed of 12,000 rpm for 10 minutes) and then filtered. The operation in which 300 parts by mass of ion-exchanged water was added to the obtained filter cake and the resultant mixture was mixed (using the TK-type homomixer at a rotation speed of 12,000 rpm for 10 minutes) and thereafter filtered was carried out twice. To the obtained filter cake, 20 parts by mass of a 10% by mass sodium hydroxide aqueous solution was added and the resultant mixture was mixed using the TK-type homomixer (at a rotation speed of 12,000 rpm for 30 minutes) and thereafter filtered under reduced pressure. To the obtained filter cake, 300 parts by mass of ion-exchanged water was added and the resultant mixture was mixed using the TK-type homomixer (at a rotation speed of 12,000 rpm for 10 minutes) and thereafter filtered. The operation in which 300 parts by mass of ion-exchanged water was added to the obtained filter cake and the resultant mixture was mixed (using the TK-type homomixer at a rotation speed of 12,000 rpm for 10 minutes) and thereafter filtered was carried out twice. To the obtained filter cake, 20 parts by mass of 10% by mass hydrochloric acid was added and the resultant mixture was mixed using the TK-type homomixer (at a rotation speed of 12,000 rpm for 10 minutes) and thereafter filtered.

—Adjustment of Surfactant Amount—

To the filter cake obtained by the above washing, 300 parts by mass of ion-exchanged water was added and the electric conductivity of the toner dispersion liquid was measured after mixing with the TK-type homomixer (at a rotation speed of 12,000 rpm for 10 minutes). The surfactant concentration of the toner dispersion liquid was calculated from the calibration curve of the surfactant concentration prepared previously. From this value, ion-exchanged water was added to obtain a toner dispersion liquid so that the concentration of the surfactant is the target surfactant concentration of 0.05% by weight.

—Surface Treatment Process—

The toner dispersion liquid adjusted to the predetermined surfactant concentration was heated in a water bath for 10 hours at a heating temperature of Ti of 55° C., while mixing with the TK-type homomixer at 5,000 rpm. Thereafter, the toner dispersion liquid was cooled to 25° C. and filtered. To the obtained filter cake, 300 parts by mass of ion-exchanged water was added and the resultant mixture was mixed using the TK-type homomixer (at a rotation speed of 12,000 rpm for 10 minutes) and thereafter filtered.

—Drying—

The obtained final filter cake was dried at 45° C. for 48 hours in a circulating air dryer and sieved with a sieve having a mesh size of 75 μm to give Toner Base Particles 1.

—Treatment with External Additives—

Relative to 100 parts by mass of Toner Base Particles 1, 3.0 parts by mass of hydrophobic silica having an average particle size of 100 nm, 1.0 part by mass of titanium oxide having an average particle size of 20 nm, and 1.5 parts of hydrophobic silica fine powder having an average particle size of 15 nm were mixed by a Henschel mixer to give [Toner 1].

<Preparation of Developer>

[Carrier 1] to [Carrier 26] (930 parts by mass) and Toner 1 (70 parts by mass) obtained in Examples and Comparative Examples were mixed and stirred using Turbula mixer at 81 rpm for 5 minutes to prepare [Developer 1] to [Developer 26] for evaluation. The developer for replenishment was prepared using the carrier and the toner so that the toner concentration was 95% by mass.

<Evaluation of Developer Properties>

Using obtained Developers, images were evaluated using RICOH Pro C7110S (digital color copier/printer multifunction peripheral, manufactured by Ricoh Co., Ltd.). Specifically, the machine was placed in an environmental evaluation room (normal temperature and normal humidity environment of 25° C. and 55%) and left to stand for one day. Thereafter, using Developers 1 to 26 of Examples and Comparative Examples and Toner 1, initial background fogging, edge carrier adhesion, and solid carrier adhesion were evaluated.

<Background Fogging>

The background fogging was evaluated by stopping a white paper image during developing, transferring the toner on the photoconductor after developing onto a tape, and measuring the difference (Δ ID) from the image density of the untransferred tape with 938 Spectrodensitometer (manufactured by X-Rite Inc.). Evaluation criteria are as follows:

0 or larger and smaller than 0.005: A (Very good)

0.005 or larger and smaller than 0.01: B (Good)

0.01 or larger to smaller than 0.02: C (Usable)

0.02 or larger: D (Poor)

<Edge Carrier Adhesion>

An image in which solid parts and white parts are alternately arranged in vertical and horizontal directions with a size of 170 m×170 μm as one square formed in developing conditions (charging potential (Vd): −630 V, developing bias: DC-500 V) was output in A3 size and the number of white spots in the image due to carrier adhesion at the boundary of squares was counted. Evaluation criteria are as follows:

The number of carrier adhesion is 0: A (Very good)

The number of carrier adhesion is 1 to 3: B (Good)

The number of carrier adhesion is 4 to 10: C (Usable)

The number of carrier adhesion is 11 or more: D (Poor)

<Solid Carrier Adhesion>

The solid carrier adhesion was evaluated by interrupting image formation of a solid image using a method of turning off the power source during the image formation in predetermined developing conditions (charging potential (Vd): −600 V, potential after exposure of the part corresponding to image part (solid image): −100 V, and developing bias: DC-500 V) or the like and thereafter counting the number of carrier adhesion on the photoconductor after transfer. The area to be evaluated was determined to be a region of 10 mm×100 mm on the photoconductor. Evaluation criteria are as follows:

The number of carrier adhesion is 0: A (Very good)

The number of carrier adhesion is 1 to 3: B (Good)

The number of carrier adhesion is 4 to 10: C (Usable)

The number of carrier adhesion is 11 or more: D (Poor)

Subsequently, running evaluation was carried out. Using Developers 1 to 26 of Examples and Comparative Examples and Toner 1 in RICOH Pro C7110S (digital color copier/printer multifunction peripheral, manufactured by Ricoh Co., Ltd.), the evaluations of the background fogging, the edge carrier adhesion, and the solid carrier adhesion were carried out at an initial stage, after run of 100,000 copies, 200,000 copies, and 1 million copies with an image area ratio of 40%. Evaluation criteria were the same as above.

The results of the image evaluations are listed in Table 1.

TABLE 1

| | | Number of printed sheet | | | | | |
|---|---|---|---|---|---|---|---|
| | | Initial | | | 100,000 sheets | | |
| | | Evaluation item | | | | | |
| | Carrier No. | Background fogging | Edge carrier adhesion | Solid carrier adhesion | Background fogging | Edge carrier adhesion | Solid carrier adhesion |
| Carrier Examples | 1 | A | A | A | A | A | A |
| | 2 | A | A | A | A | A | A |
| | 3 | A | A | A | A | A | A |
| | 4 | B | A | A | A | A | A |
| | 5 | B | A | A | A | A | A |
| | 6 | A | A | A | A | A | A |

TABLE 1-continued

| | | | | | | | |
|---|---|---|---|---|---|---|---|
| | 7 | A | A | A | A | A | A |
| | 8 | A | A | A | B | A | A |
| | 9 | A | A | A | B | A | A |
| | 10 | A | A | A | A | A | A |
| | 11 | B | A | A | B | A | A |
| | 12 | A | A | A | A | A | A |
| | 13 | A | A | A | B | A | A |
| | 14 | A | A | A | A | A | A |
| | 15 | A | A | A | A | A | A |
| | 16 | A | B | A | A | B | A |
| | 17 | B | A | A | B | A | A |
| | 18 | A | B | A | A | A | A |
| | 19 | A | B | A | A | A | A |
| | 20 | B | A | A | B | A | A |
| | 21 | B | A | A | B | A | A |
| Carrier Comparative Examples | 22 | A | A | A | A | A | A |
| | 23 | B | A | A | A | B | A |
| | 24 | A | A | A | A | A | C |
| | 25 | A | A | A | B | A | A |
| | 26 | B | A | A | C | A | A |

| | | Number of printed sheet | | | | | |
|---|---|---|---|---|---|---|---|
| | | 200,000 sheets | | | 1,000,000 sheets | | |
| | | Evaluation item | | | | | |
| | Carrier No. | Back-ground fogging | Edge carrier adhesion | Solid carrier adhesion | Back-ground fogging | Edge carrier adhesion | Solid carrier adhesion |
| Carrier Examples | 1 | A | A | A | A | A | A |
| | 2 | A | A | A | C | A | A |
| | 3 | A | A | A | B | A | A |
| | 4 | A | A | A | A | B | B |
| | 5 | A | B | A | A | C | B |
| | 6 | A | A | B | A | A | C |
| | 7 | A | A | A | A | A | B |
| | 8 | A | A | A | A | A | A |
| | 9 | B | A | A | B | A | A |
| | 10 | B | A | A | C | A | B |
| | 11 | B | A | A | B | A | A |
| | 12 | A | B | B | C | C | C |
| | 13 | B | B | A | B | B | A |
| | 14 | A | A | A | B | A | A |
| | 15 | A | A | A | B | A | A |
| | 16 | A | B | A | A | B | A |
| | 17 | B | A | A | B | A | A |
| | 18 | A | A | B | C | A | C |
| | 19 | A | A | A | A | A | C |
| | 20 | A | A | A | A | A | A |
| | 21 | B | A | A | B | A | A |
| Carrier Comparative Examples | 22 | B | A | A | D | A | A |
| | 23 | A | C | A | A | D | B |
| | 24 | B | A | C | D | A | D |
| | 25 | C | A | A | D | A | A |
| | 26 | D | A | A | D | A | A |

From the results of Table 1, it was proved that the carriers of each Example satisfying the conditions of a long diameter of the chargeable fine particles of 400 to 900 nm and a shape factor SF-1 of the chargeable fine particles of 160 to 250 had sufficient charging ability, can supply the stable amount of the developer to the developing area, and can obtain the image quality required in the field of production printing. On the other hand, in each of Comparative Examples, all of the above conditions are not satisfied and thus at least one of the evaluation properties deteriorates.

REFERENCE SIGNS LIST

1*a* Electrode
1*b* Electrode
2 Fluorocarbon resin container
3 Carrier
10 Process cartridge
11 Photoconductor
12 Charging unit
13 Developing part
14 Cleaning unit

CITATION LIST

Patent Literature

PTL 1: Japanese Patent No. 5327500

The invention claimed is:

1. A carrier for developing an electrostatic latent image, the carrier comprising:

a core material particle and a resin layer covering a surface of the core material particle, wherein the resin layer includes a resin and at least one kind of a fine particle;

the at least one kind of the fine particles includes a conductive fine particle and a chargeable fine particle;

the chargeable fine particle has a long diameter of 400 to 900 nm; and the chargeable fine particle has a shape factor SF-1 of 160 to 250.

2. The carrier for developing an electrostatic latent image according to claim 1, wherein the resin layer has a thickness of 0.2 to 2.0 μm.

3. A two-component developer comprising:

the carrier for developing an electrostatic latent image according to claim 1; and a toner.

4. The two-component developer according to claim 3, wherein the toner is a color toner.

5. An image forming device comprising:

an electrostatic latent image bearer;

a charging unit configured to charge the latent image bearer;

an exposure unit configured to form an electrostatic latent image on the latent image bearer;

a developing unit configured to develop the electrostatic latent image formed on the electrostatic latent image bearer using the two-component developer according to claim 3 to form a toner image;

a transfer unit configured to transfer the toner image formed on the electrostatic latent image bearer to a recording medium; and a fixing unit configured to fix the toner image transferred to the recording medium.

6. A process cartridge comprising:

an electrostatic latent image bearer;

a charging unit configured to charge a surface of the electrostatic latent image bearer;

a developing unit configured to develop an electrostatic latent image formed on the electrostatic latent image bearer using the two-component developer according to claim 3; and a cleaning unit configured to clean the electrostatic latent image bearer.

7. An image forming method comprising:

forming an electrostatic latent image on an electrostatic latent image bearer;

developing the electrostatic latent image formed on the electrostatic latent image bearer with the two-component developer according to claim 3 to form a toner image;

transferring the toner image formed on the electrostatic latent image bearer to a recording medium; and fixing the toner image transferred to the recording medium.

8. The carrier of claim 3, wherein the chargeable fine particle exhibits reverse chargeability with respect to the toner and imparts negative chargeability to the toner through friction with the toner.

9. A developer for replenishment comprising a carrier and a toner, wherein the developer includes 2 to 50 parts by mass of the toner relative to 1 part by mass of the carrier, and the carrier is the carrier for developing an electrostatic latent image according to claim 1.

* * * * *